United States Patent [19]

Schiele et al.

[11] Patent Number: 4,640,181

[45] Date of Patent: Feb. 3, 1987

[54] AUTOMATIC GUN LOADING DEVICE FOR A TANK

[75] Inventors: August Schiele; Wolfgang Huber, both of Augsburg, Fed. Rep. of Germany

[73] Assignee: Kuka Wehrtechnik GmbH, Fed. Rep. of Germany

[21] Appl. No.: 285,037

[22] Filed: Jul. 6, 1981

[30] Foreign Application Priority Data

May 7, 1980 [DE] Fed. Rep. of Germany ..... 3025501

[51] Int. Cl.[4] ..... F41F 9/10

[52] U.S. Cl. ..... 89/46; 89/47

[58] Field of Search ..... 89/45, 46, 47

[56] References Cited

U.S. PATENT DOCUMENTS

| | | | |
|---|---|---|---|
| 653,071 | 7/1900 | Dawson et al. | 89/46 |
| 4,318,331 | 3/1982 | Echtler et al. | 89/46 |
| 4,326,446 | 4/1982 | Magnuson | 89/45 |

FOREIGN PATENT DOCUMENTS

| | | | |
|---|---|---|---|
| 1578093 | 5/1971 | Fed. Rep. of Germany . | |
| 966693 | 10/1950 | France | 89/46 |
| 9548 | of 1896 | United Kingdom | 89/45 |

*Primary Examiner*—Stephen C. Bentley
*Attorney, Agent, or Firm*—McGlew and Tuttle

[57] ABSTRACT

A device for automatically loading a large-caliber cartridge into the gun bore of a gun carried by a tank turret, comprises a revolving magazine mounted for rotation about the rotational axis of the turret, and independently of the rotation of the turret. The revolving magazine includes two vertical levels of magazine compartments lying radially in the magazine with cartridges facing toward the rotational axis. The revolving magazine includes an elevator which can lift a cartridge from the uppermost level of magazine compartments into a breach opening area of the gun barrel whereat the cartridge can be rammed into the gun barrel bore. In a forward trough area of the tank carrying the tank turret, a second magazine is provided having a plurality of chutes each with at least three cartridges stacked one on top of the other. The lower end of the second magazine is positioned above the lower level of magazine compartments of the revolving magazine so that, with a cartridge pickup device cartridges can be transferred from the second magazine into vacant compartments of the revolving magazine. A rammer is provided for this purpose.

6 Claims, 6 Drawing Figures

AUTOMATIC GUN LOADING DEVICE FOR A TANK

FIELD AND BACKGROUND OF THE INVENTION

The present invention relates to a device for the automatic loading of a gun with large-caliber ammunition, the gun being mounted in a tank turret. The device includes a magazine mounted to revolve coaxially with the turret, and an elevator, which at zero elevation for the gun bore axis, allows a cartridge from the revolving magazine to be raised in front of a gun cartridge opening to supply the cartridge to the gun.

In a known design of this type (DE-OS 1578093) a carrier ring is rotatably mounted on the inner periphery of the turret rotary cage, for rotation with the turret, and with respect to the turret. The carrier ring forms a revolving magazine whereby thereon single slide units each for one cartridge are mounted around and adjacent each other. On top, the slide units have a reverse T slot, which, together with all the other slide unit slots, forms a snap ring groove, into which the crosshead of an elevator thread can slide, this thread being run in the top plate of the gun bore axis. In this way, the slide unit carrying the cartridge therebelow with a downwardly suspended projectile, can be pulled up and be forwardly tilted into a horizontal position by means of a tilting mechanism. Subsequently, a rammer can move the cartridge from the slide unit and insert it into the gun barrel. Following the cartridge loading step, the empty slide again must be returned to the carrier of the revolving magazine to close the snap-ring groove circle. The cartridges arranged around and adjacent each other are limited to a single layer therein. Therefore, no large amount of cartridges can be accommodated. The adding of another magazine is neither provided for nor possible so that no increase in the ammunition store to be carried along can be considered. The turret combat space all around is limited by the arrangement of the cartridges on the inner periphery of the rotary cage. The cartridge is relatively high in position with a resultant high-set center of gravity. The cartridge elevator operates in stages of an upward-and swiveling motion. The pickup of each single cartridge in its own slide unit is complicated and requires additional empty space.

SUMMARY OF THE INVENTION

In contradistinction to the foregoing, the basic object of the invention is to store as many cartridges as possible, e.g. 50 150-caliber pieces, in the vehicle, i.e. to control their delivery from the magazine to the weapon cartridge opening, so that a rapid rate of fire at an interval of a few seconds is feasible, whereby the ammunition is stored at a maximal depth for boosting its safe storage. As a further object, the engineering means used for implementing this type of group assembly are maximally compact and safe to operate, and can be so simply broken down that, under emergency conditions, at least components of these means can also be operated manually.

Accordingly, an object of the present invention is to provide a device for the automatic loading of large-caliber ammunition in the gun of a tank turret, the turret having a cage with a bottom, comprising a revolving magazine rotatably mounted about the same axis as the turret for co-rotation and indepedent rotation with respect to the turret, a plurality of radially extending magazine compartments in the revolving magazine each for receiving a cartridge, with the cartridges pointing toward the rotational axis of the turret. Vertically, the rotating magazine has room for at least two cartridges, one on top of the other. A trough is provided in a body of the tank ahead of the turret with respect to a forward direction of movement for the tank having a driver's seat laterally thereof. A second magazine is positioned in the trough with a lower end above the lowest position for cartridges in the revolving magazine. The second magazine has a plurality of chutes that are positioned laterally adjacent each other and extend parallel to a longitudinal axis of the tank. The chutes accommodate at least three superimposed cartridges. A cartridge pickup is movable below the second magazine for receiving one cartridge at a time and feeding it to an empty magazine compartment of the revolving magazine which is aligned with the rotation axis of the turret. A first cartridge rammer is provided for moving the cartridges from the cartridge pickup to the empty magazine compartment. A cartridge elevator is provided in the turret cage for lifting a cartridge from a position in the revolving magazine which is opposite the rotational axis from a gun on the turret, to lift a cartridge from the revolving magazine to a cartridge opening that is aligned with the gun bore axis when the gun is in an unelevated position.

Because of the magazine distribution according to the invention, into two sub-magazines, not only a high piece number of carried-along cartridges is assured but also their low-positioned storage, which is desirable from a safety point of view and which also contributes to reducing the total height of the tank. This distribution also facilitates a manual operability under emergency conditions. The independence of the revolving magazine rotary motion from any turret rotary motion facilitates a reloading of the revolving magazine from a second magazine regardless of any tactical situation-dictated lateral gun alignment. Furthermore, it allows for the changing of the type of ammunition if so required by changing combat conditions.

In the same way that each of the radial compartments of the revolving magazine are turned beneath the cartridge elevator and that way can be kept ready for the fetching of cartridges, the latter stage can be re-executed on a second magazine by means of a cartridge pickup from beneath the chutes. On preselecting the type of ammunition by the gun loader, the cartridges can be electromechanically scanned.

The invention allows for both a mechanical magazine refilling with new cartridges, and a manual refilling. In a particularly simple way this can be accomplished by developing the chutes of the second magazine to be capable of being inverted and lifted.

BRIEF DESCRIPTION OF THE DRAWINGS

An exemplified embodiment of the device according to the invention is illustrated in the attached drawings, wherein.

DESCRIPTION OF THE PREFERRED EMBODIMENT

Figure 1:
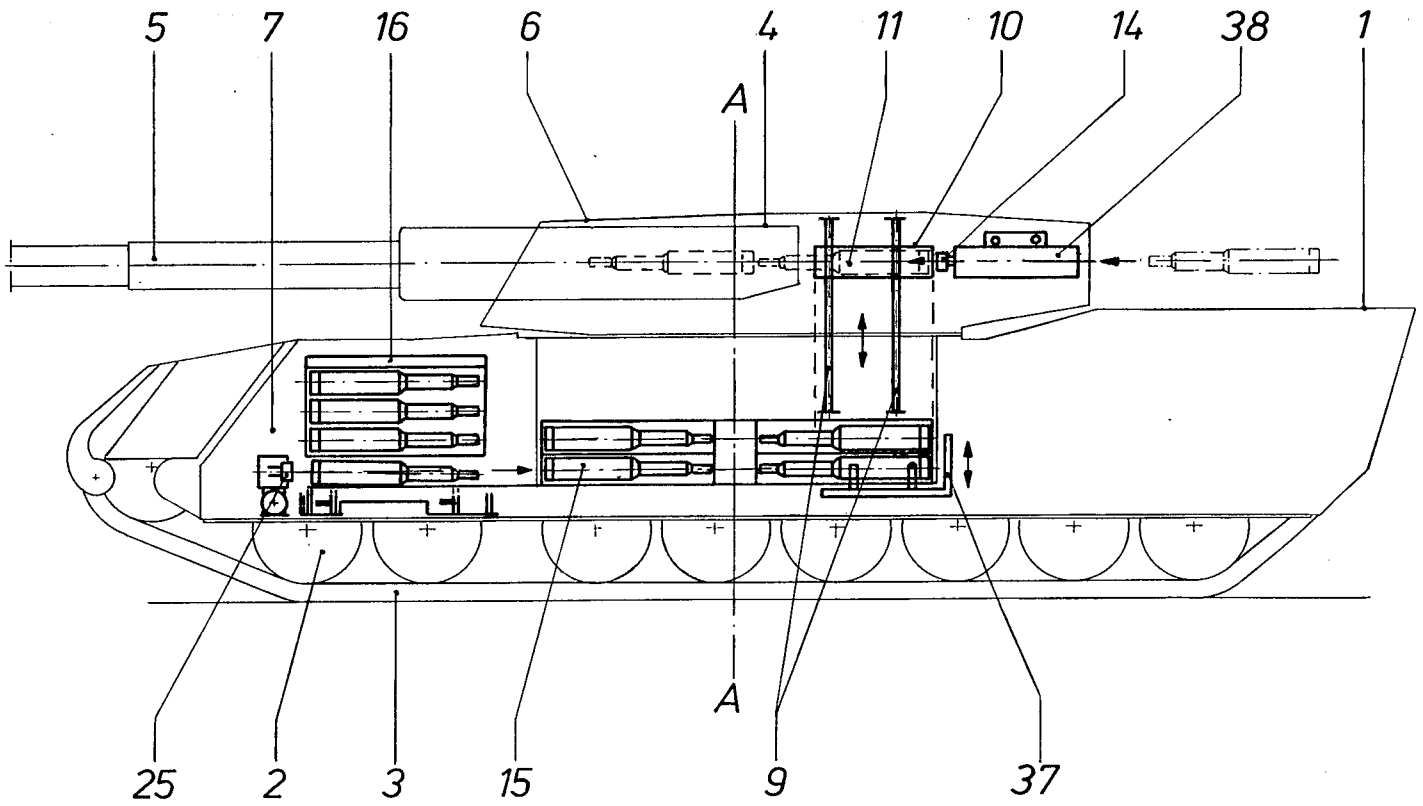
FIG. 1 shows a partially sectional, longitudinal view of a tank with the invention.
Figure 2:
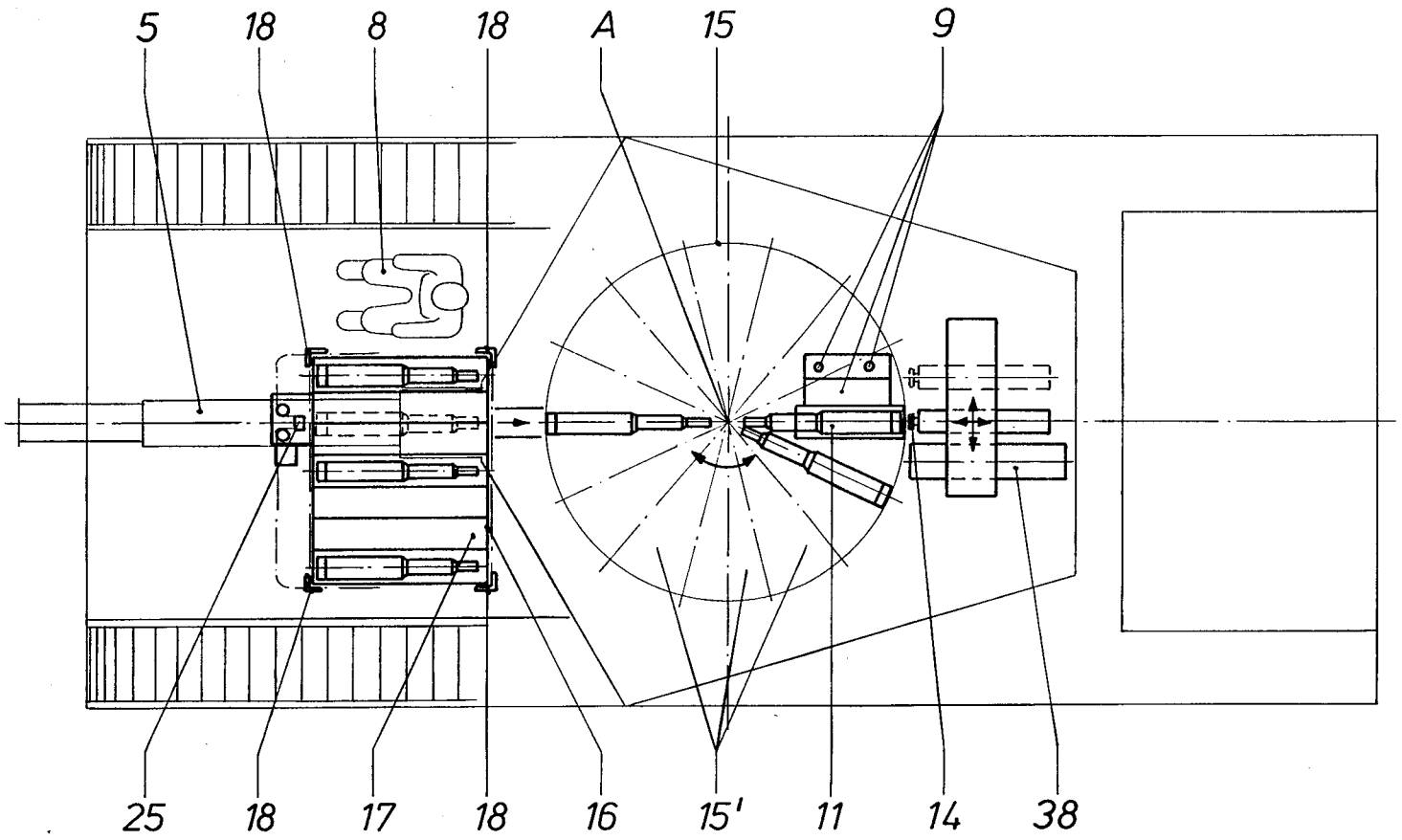
FIG. 2 is a top view of FIG. 1, also partly in section.

As shown in FIG. 1, a tank has a tank contour 1, and chain wheels 2 with one of the chains 3 also visible. A turret 6, swivelable around its swiveling axis at line A—A, and carrying the gun 4 with its barrel 5 are also shown. In front of the turret a vehicular trough 7 is located in which, on one side at 8, there is the driver seat as shown in FIG. 2. The turret 6 has a cage 6' (FIG. 5) sunk under the contour 1 and having a bottom 6". The turret carries a cartridge elevator 9 in parallel with the swiveling axis line A—A behind the cartridge opening or station 10 of the gun 4 for the immediate insertion of a cartridge 11 in the opening 10. Opening 10, relative to the barrel 5, is also behind the line A—A, and aligned with the bore axis of gun 4, when the gun is a zero elevation.

Figure 6:
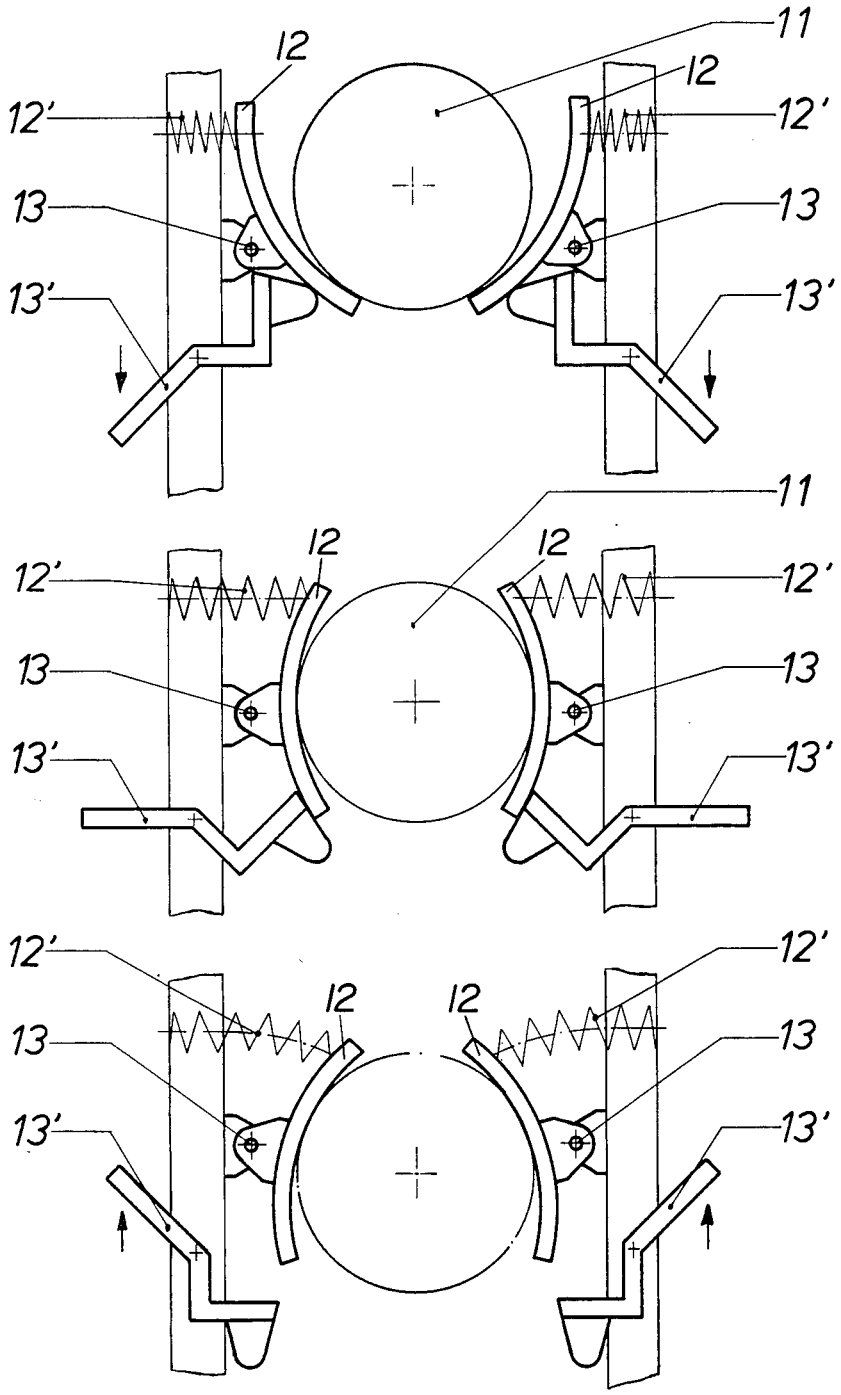
FIG. 6 shows three various phases from the cartridge elevator.

The cartridge elevator 9 is equipped with two clamping jaws 12 (see FIG. 6) which each have a swiveling axis 13 and are movable counter to the pressure of spring loads 12' by means of lever pairs 13'. In the bottom elevator position the clamping jaws 12 are moved by the lever pairs 13' in such a way that they can receive a cartridge from a radial magazine compartment 15' of a revolving magazine 15 immediately under, and coaxially rotatable with the turret 6 (i.e. around the same swiveling axis A—A). The topmost cartridge can thus be picked up from magazine 15. In the next elevator transport phase of cartridge 11, the cartridge is solidly clamped between the jaws 12. In the top elevator position the cartridge 11 is set in front of the cartridge opening 10 and is held by the clamping jaws 12 in such a way that it can be shifted into a bore of the gun, longitudinal along an axial direction by a rammer 14 mounted in turret 6.

The cartridges 11, even at their pickup stage from the revolving magazine 15, lie parallel to the gun bore axis and fit into the cartridge opening 10, because in the revolving magazine 15, they are filed in the radial magazine compartments 15' and point toward the swiveling axis line A—A. In this way also a maximal number of magazine compartments can be accommodated in the revolving magazine 15, e.g. fourteen 120 mm-caliber cartridges. With two superposed layers, this results in a pickup capacity of twenty-eight cartridges in the revolving magazine 15. The magazine 15 is, independent from any turret rotary motion which is used for lateral shifts of the gun, separately rotatable, primarily also in cases, where various types of ammunition are to be selectively fired, e.g. with explosive or shaped charges. For this purpose its revolving magazine is open all around the top. The magazine 15 is covered all around by and positioned under the turret bottom 6" except for an opening in the bottom 6" beneath the cartridge elevator 9. Magazine 15 is also open on its periphery for the automatic loading of its empty compartments from a second magazine 16. This second magazine comprises a plurality of (in the drawing seven) laterally adjacent chutes 16', which extend in a vehicular-longitudinal direction, and are accommodated in the vehicular trough 7 ahead of the turret and laterally next to the driver seat 8 above the level of the cartridge bottom position in the revolving magazine 15, e.g. each chute is in the shape of a container 17 insertable and liftable relative to the trough 7, and supported on and between back squares 18. In each chute 16' there is a space for three cartridges superposed on each other, and each braced by an arm 19 (FIG. 4). To extract a cartridge from the chute all arms 19 are simultaneously turned clockwise on their carrier shafts 20, i.e., counter their respective pressure spring loads 21, to the point where the respectively bottom cartridge has dropped into the cartridge pickup 22, whereupon the arms 19 block the dropping of any further cartridge. The cartridge pickup 22 (FIG. 3) is laterally movable by means of an endless chain 24 looped around rollers 23 beneath the chutes 16'. Furthermore, the pickup 22, to facilitate the release of a cartridge 11, can be lifted toward the respective chute 16', which can be accomplished by the chain 24 or a further moving belt. Finally, pickup 22 is moved in front of that revolving magazine compartment 15', ahead of which the cartridge picked up is aligned with the swiveling axis A—A (see FIG. 2). By means of a rammer 25 located there, the cartridge is removed from the cartridge pickup 22 and transferred to an empty compartment 15' of revolving magazine 15. There the cartridge is turned to its position beneath the cartridge elevator 9, whence it is immediately shoved in and/or in front of the cartridge opening 10 of gun 4, after having been lifted from the bottom to the top position by means of a lifting device 37 stationed in turret 6.

Figure 3:
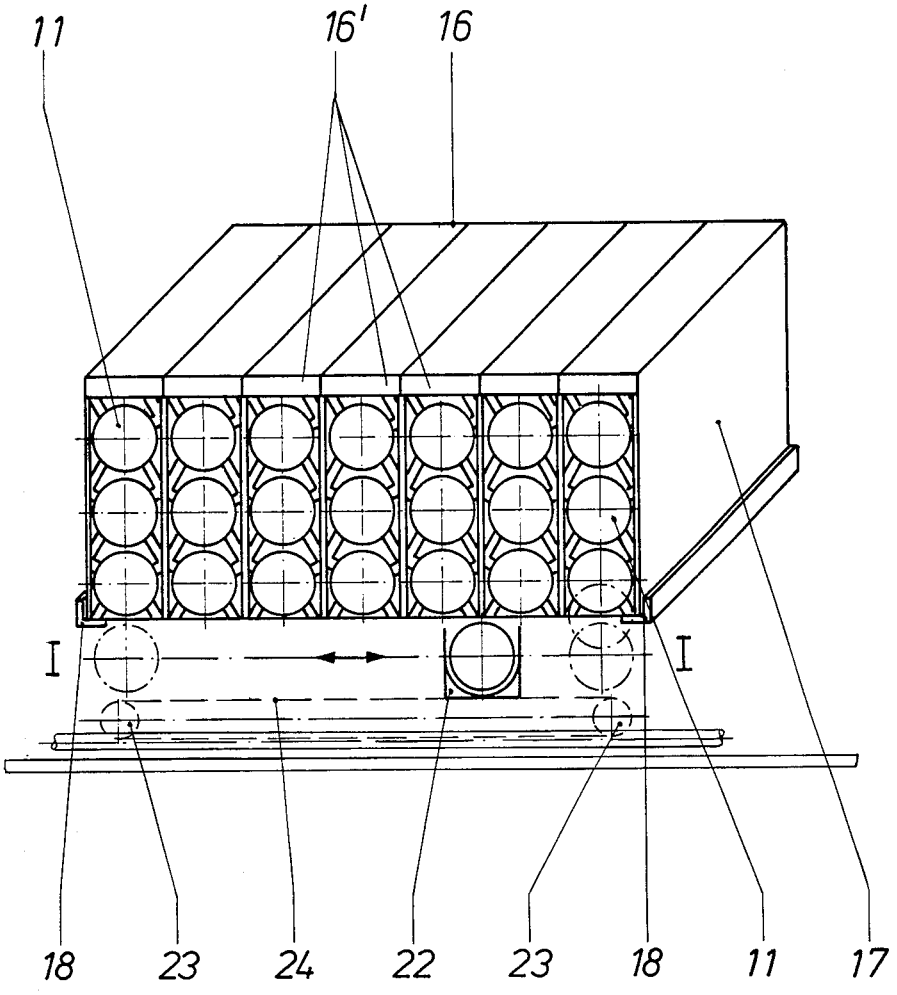
FIG. 3 is a perspective view of the second magazine having traversable cartridge pickup.
Figure 4:
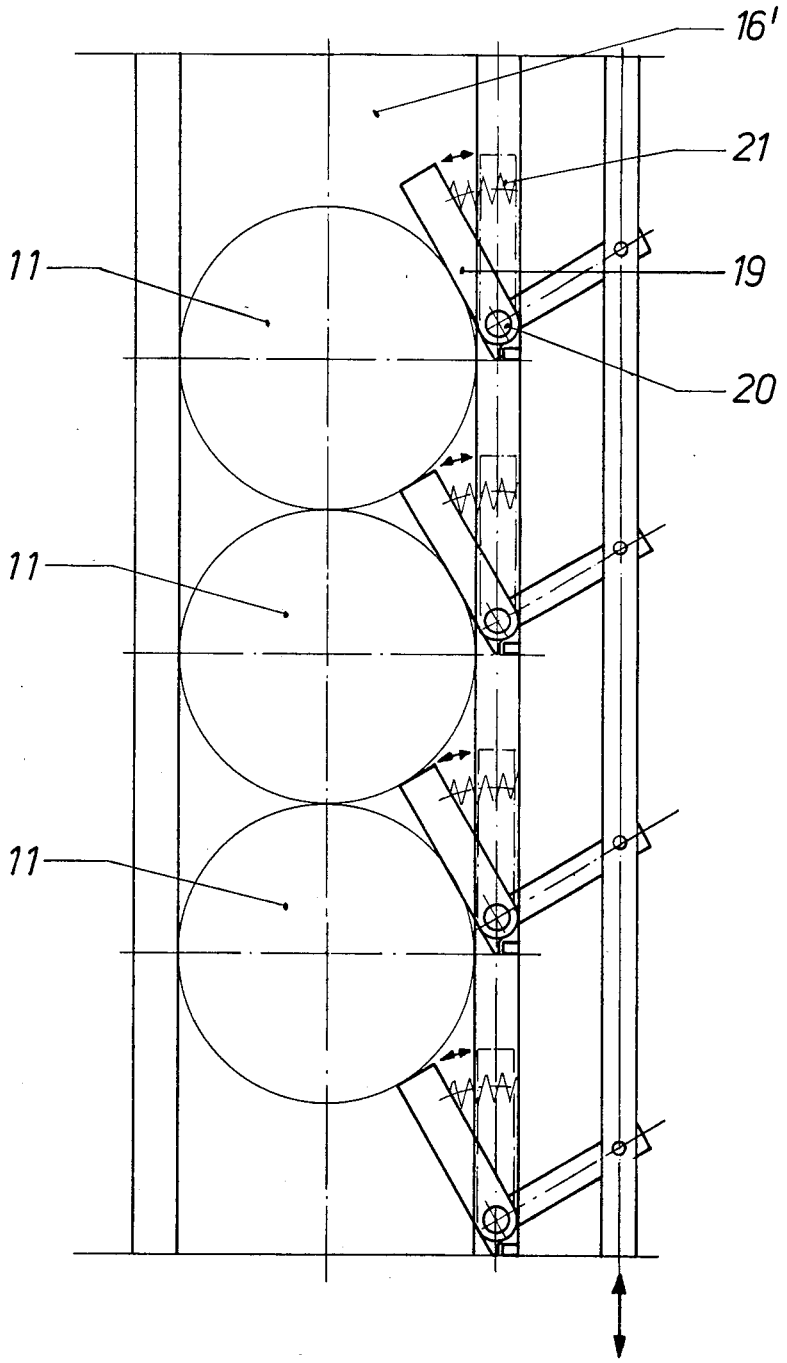
FIG. 4 is a detail view of a chute of the second magazine.

In the exemplified embodiment of FIG. 3, the capacity of the second magazine 16, has reached twenty-one cartridges, in addition to which one cartridge can be in reserve in cartridge pickup 22, which then totals twenty-two cartridges. Together with the twenty-eight cartridges in the revolving magazine, therefore, fifty cartridges can be magazine-stored.

Figure 5:
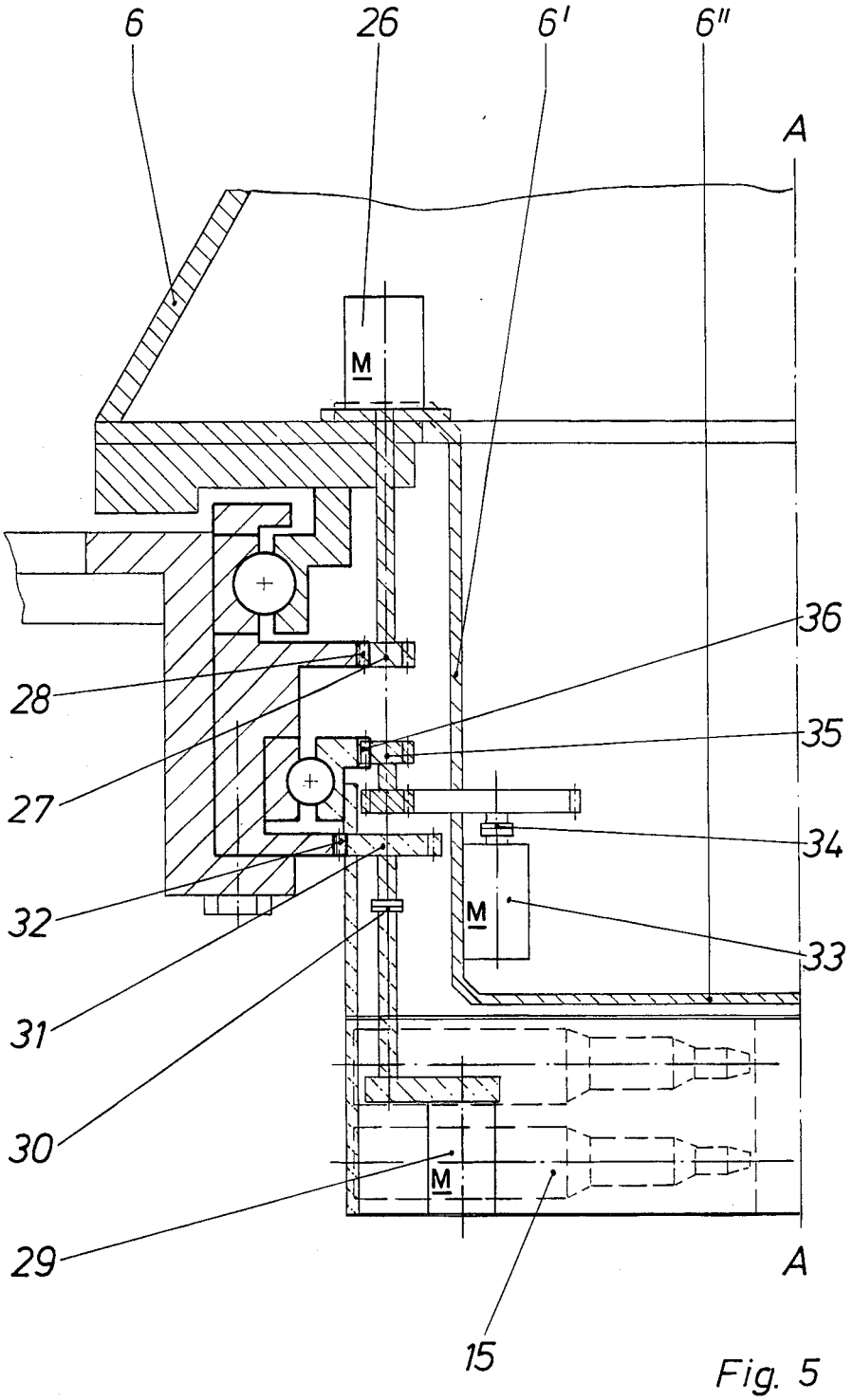
FIG. 5 is a sectional detail view of of the turret and the revolving magazine with their turntable drives.

To turn the turret 6 around its swiveling axis A—A, according to FIG. 5, a motor 26, the pinion 27 of which projects from the turret into the tank interior and there meshes with a toothed wheel 28, is used. In the revolving magazine 15 therebeneath, a motor 29 is seated, this motor being connectable, via a coupling 30, to a pinion 31, which meshes with a toothed wheel 32 in the tank interior. In this way the revolving magazine 15 can be turned independently from the turret, i.e. relative to the trough. Finally mounted in the turret there is a motor 33, which, with its toothed wheel 35, via a coupling 34 meshes with cogs a toothed wheel 36 of revolving magazine 15. With coupling 34 in a coupled-in state and idling motor 33, the revolving magazine 15 is in solid rotational connection with the turret, that is, is carried along by the rotation thereof, provided the coupling 30 is open (uncoupled).

An external reloading can be accomplished, as indicated in FIG. 1, by means of a loading shell or housing 38.

We claim:

1. A device for automatically loading large-caliber ammunition into a gun mounted on a rotatable turret of a tank, the gun having a bore for receiving a cartridge and a zero elevation position with respect to the turret, the turret rotatably mounted to the tank about an axis of rotation, and the tank movable in a forward direction having a longitudinal axis parallel to the forward direction, and a driver seat at one side of the longitudinal axis in front of the turret in the forward direction, the device comprising:

a first magazine rotatably mounted to the tank below the turret and about the axis of rotation of the turret, said first magazine having at least two substantially horizontal levels for at least two vertically spaced cartridges to be held one over the other, and a plurality of radially extending magazine compartments at each level for carrying a plurality of cartridges at each level pointing toward the axis of rotation, said first magazine being independently rotatable with respect to the turret;

an elevator mounted in the turret at a position to lift a cartridge from one of said radial compartments to a cartridge station in alignment with the gun bore when the gun is in its zero elevation position, said elevator mounted for movement parallel to the axis of rotation;

means defining a vehicular trough in the tank, in front of the turret in the forward direction and next to the driver's seat;

a second magazine disposed in said trough and having a plurality of chutes disposed, one next to the other, transversely of the forward direction, each chute extending parallel to the longitudinal axis of the tank and having a space for a single vertical stack of at least three cartridges facing rearwardly of the forward direction, a lowermost position for a cartridge in each chute being above a lowermost one of said levels of said first magazine;

a cartridge pickup movably mounted to the tank below said second magazine for movement of a cartridge from a lowermost position in each chute to a position parallel to the longitudinal axis and adjacent one magazine compartment at said lowermost level of said first magazine;

first drive means connected to said cartridge pickup for moving said cartridge pickup laterally of the longitudinal axis from said lowermost position of each chute to said position parallel to the longitudinal axis; and a first rammer mounted to the tank in a position forward of said cartridge pickup and parallel to said position of said pickup which is parallel to the longitudinal axis, for ramming a cartridge carried by said pickup into the one of said magazine compartments at said lowermost level which is parallel to the longitudinal axis.

2. A device according to claim 1, wherein said elevator comprises a pair of clamping jaws each pivotally mounted about a separate swivel axis and second drive means connected to said pair of clamping jaws for moving said clamping jaws to a first position with said elevator in a lowermost position for opening a lower mouth of said clamping jaws to receive a cartridge from a radial compartment of said first magazine, an intermediate position for holding a cartridge from said first magazine between said clamping jaws, and an upwarldy open position for opening an upper mouth between said clamping jaws with a cartridge between said clamping jaws at said cartridge station which is in alignment with the gun bore with the gun in its zero elevation position.

3. A device according to claim 2, wherein said second drive means comprises a pair of spaced-apart upright supports each carrying one of said swivel axes, a biasing spring between each clamping jaws and each upright respectively for biasing said clamping jaws to pivot to open a lower mouth therebetween, and a driving lever pivotally mounted to each upright support and engageable with each clamping jaw respectively for moving each clamping jaw.

4. A device according to claim 1, wherein said first drive means comprises a pair of roller means rotataby mounted at laterally spaced positions with respect to the longitudinal axis and an endless conveyor member entrained around said roller members and connected to said cartridge pickup.

5. A device according to claim 3, wherein said first drive means comprises a pair of roller means rotatably mounted at laterally spaced positions with respect to the longitudinal axis and an endless conveyor member entrained around said roller members and connected to said cartridge pickup.

6. A device according to claim 3, including third drive means connected between said first magazine and the tank for rotating said first magazine, fourth drive means connected between the turret and the tank for rotating the turret, fifth drive means connected between said first magazine and the turret for rotating said first magazine with respect to the turret and clutch means in at least one of said third, fourth and fifth drive means for selectively engaging and disengaging said at least one of said third, fourth and fifth drive means to permit independent and dependent rotation of said first magazine with respect to the turret.

* * * * *